United States Patent [19]

Miner et al.

[11] 4,096,805

[45] Jun. 27, 1978

[54] AIR TARGET FUZE DECISION CIRCUIT

[75] Inventors: Mark S. Miner, Washington, D.C.; Charles W. Crickman, Glen Echo Heights, Md.

[73] Assignee: The United States of America as represented by the Secretary of the Army, Washington, D.C.

[21] Appl. No.: 721,134

[22] Filed: Apr. 9, 1968

[51] Int. Cl.[2] ..... F42C 13/04; F42C 13/00

[52] U.S. Cl. ..... 102/214; 343/7 PF

[58] Field of Search ..... 102/70.2; 343/7

[56] References Cited

U.S. PATENT DOCUMENTS 3,131,388 4/1968 Baker ..... 102/70.2 X

*Primary Examiner*—Samuel W. Engle
*Assistant Examiner*—Thomas H. Webb
*Attorney, Agent, or Firm*—Nathan Edelberg; Robert P. Gibson; Saul Elbaum

[57] ABSTRACT

A decision circuit for use in pulse doppler proximity fuzes which will allow the fuze to operate more effectively in the presence of electronic countermeasures and clutter by using an auxiliary receiving channel and threshold sensors.

5 Claims, 2 Drawing Figures

AIR TARGET FUZE DECISION CIRCUIT

The invention described herein may be manufactured, used and licensed by or for the Government for governmental purposes without the payment to us of any royalty thereon.

BACKGROUND OF THE INVENTION

In the design of pulse doppler radar fuzes it is necessary to meet and solve the problems surrounding the provision of means by which the fuze can operate normally in the presence of ground clutter and various types of electronic countermeasures. For example, it is desirable to have a fuze which will operate normally in the presence of ground clutter, will not be fired when subjected to sidelobe jamming, will function normally in a benign electronic countermeasures environment and will fire when a strong jamming signal is directed into the main beam. There have been numerous attempts previously to solve each of these problems separately. The circuit designs resulting from these solutions, however, have proven generally to be incompatible making it virtually impossible to obtain a fuze which will operate normally when subjected to all of the aforementioned difficulties. Further, previous solutions offered to these problems, especially those directed to electronic countermeasures, have tended to degrade the performance and reliability of the fuze's normal traget sensing operation in a benign environment.

The principle solution offered previously to meet the problem of clutter and incoherent electronic countermeasures has been the use of frequency discimination. That is, previous fuzes have provided two receiver channels of different band-press frequencies which would separate the desired from the undesired signals reaching the fuze receiver.

The most serious difficulties occur when the fuze is required to function properly in the presence of severe electronic countermeasures interference. The most probable threat is considered to be the self-screening jammer, that is, where the target aircraft carries its own source of jamming signal. The other type of jamming is provided by the so called stand-off jammer which is a ground based or airborne station which provides a jamming signal which shields the target aircraft. The threat from the self-screening jammer, however, is considered most probable since the source of jamming radiation is aboard the target aircraft, and there is no question as to relative range and location of the jammer and the target such as exists for the stand-off jammer. The effectiveness of the airborne stand-off or escort jammer would depend in large measure on the range and position of the jamming aircraft relative to the fuze, and the fuze's antenna pattern for the brief time it is active during the target intercept phase. Therefore, while the fuze design must attempt to minimize the susceptibility to the stand-off jammer, knowledge of the tactical airborne electronic countermeasures environment during the intercept in which the fuze is to be used is required to actually evaluate the vulnerability of the fuze to stand-off jamming under the particular circumstances. Lacking this information it will be assumed herein that the stand-off jammer is a real potential threat but second in importance to the self-screening jammer which constitutes a threat more real than potential. Obviously, it would be desirable that any protective means designed to shield a proximity fuze from electronic countermeasures jamming in an environment where the different types of jamming are present be able to discriminate these various different types. Unfortunately, the simple protective devices which cause a fuze to fire or not to fire in particular jamming situations do not suffice for those situations in which more sophisticated jamming techniques are used. That is, self-screening jamming and stand-off jamming impose conflicting requirements on any protective circuitry with the result that many of the simple devices used heretofore will not operate properly in such environments.

An electronic counter-countermeasure remedy previously proposed for use in an environment where both stand-off jamming and self-screeming jamming are present is to add a separate receiver channel and antenna to guard the fuze antenna sidelobes. The guard channel would be a broadbeam receiving channel adjusted to exceed the fuze antenna sidelobe gain but less than the fuze main beam gain, which would subtract from the normal fuze receiver output. The effect of this device would be to provide geometry discrimination by forcing the self-screening jammer into the fuze main beam to cause the fuze to function. That is, it would provide a situation in which a jamming signal in the main beam would cause the fuze to fire, but a similar signal in the side lobes would be prevented from causing the fuze to fire. But, this technique proved to be an incomplete solution to the problem. While the guard channel circuitry has merit in defeating the self-screening jammer, it could not be properly integrated into a fuze system which would also provide satisfactory rejection of ground clutter. The use of this electronic counter-countermeasure technique presented other difficulties including a lack of any protection against the stand-off jammer in the main beam; a lack of capability of seeing targets in the forward sidelobes, hence the inability to fuze the collision course target; possibility of a fuze dud due to a stand-off jammer in the sidelobe nulls; and the rather critical adjustments required to set the proper relationship between the guard beam, the main beam, and the sidelobe gains and the possible lack of sensitivity if this relationsip were disturbed for any reason.

It is therefore an object of this invention to provide a means which will allow a pulse doppler radar fuze to meet the conflicting requirements of being able to discriminate against ground clutter and sidelobe jamming and to fire on a strong jamming signal in the main beam while being able to function normally in a benign electronic countermeasure environment.

It is a further object of this invention to provide a means which will allow a pulse doppler radar fuze to meet the above object while maintaining adequate sensitivity and sufficient reliability.

SUMMARY OF THE INVENTION

The aforementioned and other objects are obtained in a proximity fuze in which in addition to the main receiver channel there is added a separate receiver channel and antenna to guard the main fuze antenna sidelobes. The guard channel is a broad-beam receiving channel adjusted to exceed the fuze antenna sidelobe gain but less than the fuze main beam gain which is algebraically added to the output of a high-pass (noise) amplifier operating parallel to the doppler amplifier in the main channel. The output of the doppler amplifier and the output of the high-pass (noise) amplifier which are operating in parallel in the main channel are algebraically added as well. Level sensors permit one or the other of these comparison signals to operate the fuze depending upon the signal level.

BRIEF DESCRIPTION OF THE DRAWING

The specific nature of the invention as well as other objects, aspects, uses and advantages thereof will clearly appear from the following description and the acompanying drawing in which.

DESCRIPTION OF THE PREFERRED EMBODIMENT

Figure 1:
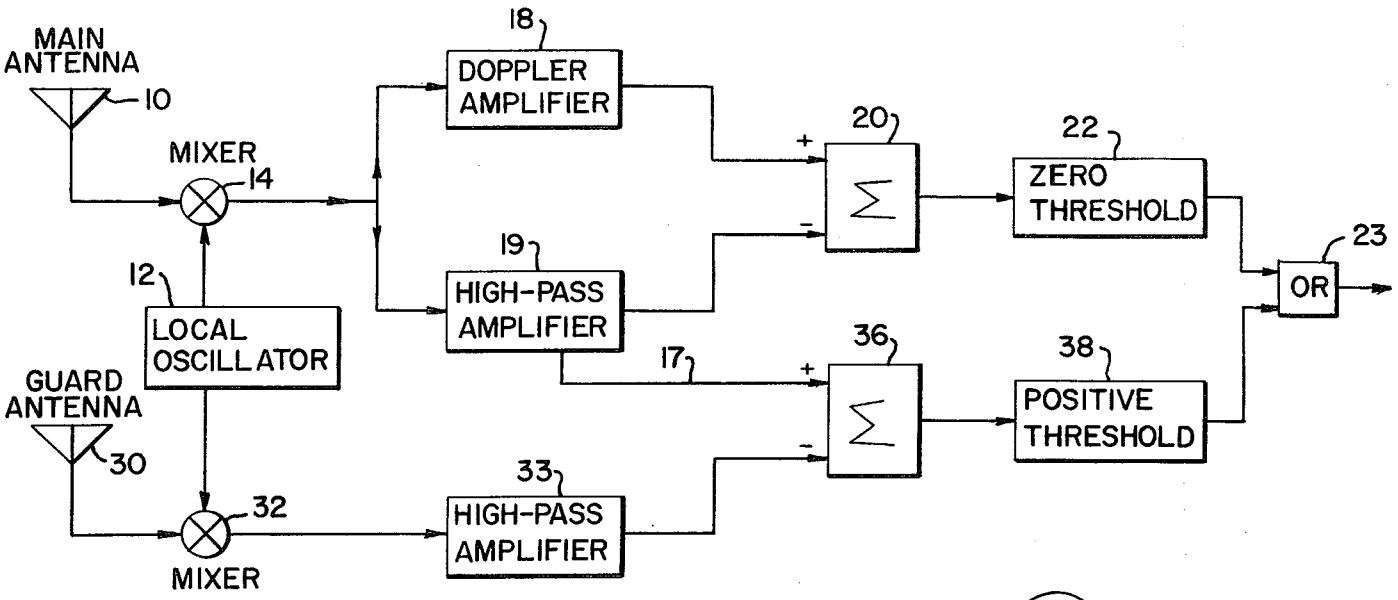
FIG. 1 is a block diagram of the proximity fuze decision circuit of our invention.

In FIG. 1, the block diagram of the decision circuit for proximity fuzes of our invention, the main antenna 10 is coupled to a mixer 14 in which the received signal is compared with a signal from local oscillator 12. The output of the mixer 14 is directed to two parallel frequency selective amplifiers, doppler amplifier 18 and high-pass (noise) amplifier 19. The band-pass of doppler amplifier 18 is selected to pass doppler modulated target signals. The band-pass of amplifier 19 is selected to lie above the frequency band associated with valid target signals. Each amplifier includes a detector and integrator so that its output will be a DC level proportional to the amplifier input level. The output of doppler amplifier 18 in this embodiment is designed to have an output of positive polarity and high-pass amplifier 19 is designed to have an output of negative polarity. Further, amplifier 19 is adjusted to have a higher gain than doppler amplifier 18. The outputs from amplifiers 18 and 19, respectively, are coupled to a summer 20 where they are added algebraically resulting in the signal representing the algebraic sum of the two amplifier output signals being coupled to a threshold detector 22. Threshold detector 22 is adjusted so that, if the output signal from summer 20 is positive, a signal will be coupled from threshold detector 22 to an OR gate 23, the output of which causes the fuze to fire.

The guard antenna channel has a separate mixer 32 coupled to the output of guard antenna 30 and to local oscillator 12 so that the local oscillator signal will be mixed with the guard antenna output as well. The signal from mixer 32 is coupled to a high-pass amplifier 33, the band-pass frequency of which is the same as that of amplifier 19. At this point, it will be noticed that another output is made available from high-pass amplifier 19 on lead 17. Another detector-integrator circuit is connected within amplifier 19 to a lower gain point than that of the output which is connected to summer 20, and in this embodiment the output on lead 17 is designed to be of a positive polarity. The output of amplifier 33 which, in this embodiment, is adjusted to be of a negative polarity is connected to a summer 36 to which, also, is connected lead 17 coupling the positive output of amplifier 19, from a lower gain point therein, to summer 36. In summer 36 these two signals are added algebraically, and the signal representing that algebraic sum is connected to a threshold detector 38. In the case of threshold detector 38, however, the level is adjusted such that an output is made available only when the input exceeds a preset positive level. If that level should be exceeded an output from threshold detector 38 will be directed to OR gate 23.

Figure 2:
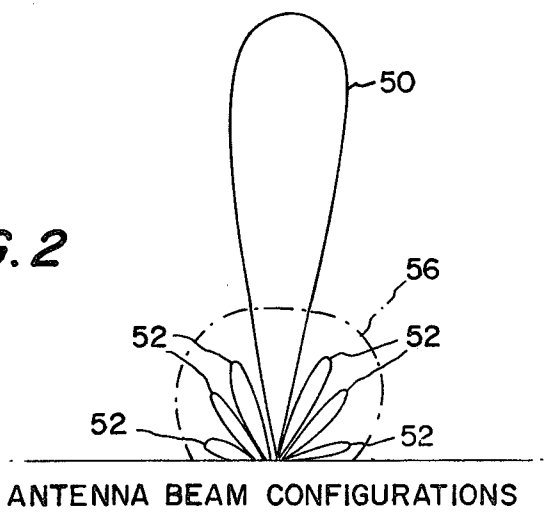
FIG. 2 is a diagram of the antenna patterns of the main antenna and the guard antenna in the decision circuit of our invention.

FIG. 2 illustrates the antenna beam patterns for the main antenna 10 and for guard antenna 30. Pattern 50 represents the main-beam of main antenna 10 and lobes 52 represent the sidelobes of the main antenna. Pattern 56 represents the antenna pattern for guard antenna 30. The gain of the guard antenna is adjusted to be greater than that of the sidelobes 52 of the main antenna but less than the gain of the main beam of the main antenna.

In order to properly describe the operation of our invention it will be necessary to discuss its operation in each of five different environments but it will be readily apparent that the circuit will function properly when more than one of these environmental characteristics are present. The first situation to be considered is when there are no electronic countermeasures signals, clutter signals, and no target signals present. It is obviously highly important that a fuze not be triggered by ambient circuit noise in the absence of other signals. The prinicipal sources of noise in this circuit will be mixers 14 and 32. In the case of mixer 14 broad band noise will pass through both amplifiers 18 and 19 with essentially equal levels being coupled thereto, and, because amplifier 19 has a higher gain, the signal from summer 20 will be of a negative polarity. Obviously, then, zero threshold detector 22 will not permit such a signal to pass. For essentially the same reasons circuit noise from mixer 32 will produce a negative signal from summer 36, and obviously, this will not pass through threshold detector 38 which, as mentioned above, is adjusted to pass only signals of a preset positive value.

In the case when only a target is present in the principal lobe of the main antenna with no jamming or clutter signals present the output of doppler amplifier 18 will exceed that of high pass amplifier 19. This is true despite the higher gain of high pass amplifier 19 because it will be remembered that the band pass of amplifier 19 lies above the frequency band associated with valid targets. Therefore, a positive signal will be available from summer 20 ill pass through zero threshold detector 22 and OR gate 23 causing the fuxe to fire.

When only ground clutter and no electonic countermeasures or target signals are present, a broad-band noise-like frequency spectrum will be produced at the mixer outputs. Both main channel amplifiers, 18 and 19, will receive a signal of the same input power, and, because of the higher gain of amplifier 19, a negative signal will be produced by summer 20 causing a threshold circuit 22 to remain in a quiescent state. In this circumstance threshold detector 38 will also remain quiescent so long as its level is set higher than the strongest clutter level.

When a jamming signal is present in the main antenna principal lobe 50, it is desirable to cause the fuze to fire because of the high probability that this signal is emanating from a self-screening jammer, as discussed above. But, because the jamming signal will produce a broad-band noise-like frequency spectrum, the main channel threshold will not be exceeded as in the case above when only ground clutter was present. The level of threshold detector 38, however, will be exceeded because the gain of the principal lobe of main antenna 10 is greater than the gain of guard antenna 30. This will produce a signal of positive polarity on lead 17 which will be of a higher magnitude than the negative signal emanating from amplifier 33. Thus, there will be an output from threshold detector 38 through OR gate 23 which will fire the fuze.

When jamming signals are present in the side lobes 52 of the main antenna, the threshold of threshold detector 22 will not be exceeded for the same reasons as above, because, again, the jamming signal will be a broad-band signal. Remembering that the gain of guard antenna 30 is greater than the gain of the sidelobes of the main antenna the negative output from amplifier 33 will be greater than the positive output of amplifier 19 on lead 17. Summer 36 will produce a negative signal, and the threshold of threshold detector 38 will, therefore, not be exceeded.

When the decision circuit of our invention is used in proximity fuzes there is no desensitizing effect by the guard channel on target echoes received in either the main-beam or sidelobes of the main antenna 10. Therefore, guard antenna design and adjustment are less critical and cannot degrade normal fuze performance in a benign environment. The added electronic counter-countermeasure ciruitry is independent of normal target sensing operations, and therefore, cannot degrade the performance or reliability of the fuze when no clutter or jamming signals are present. Furthermore, the high-powered self-screening jammer is effectively defeated and the stand-off or escort jammer is discriminated against to a very high degree. The stand-off jammer cannot cause the fuze not to fire by directing jamming power into the nulls of the main antenna pattern. This feature negates a disadvantage of the prior art circuit discussed above in which a guard channel was used and in which the fuze could be overguarded and, hence, caused not to fire by jamming power in the guard beam and not in the narrow main antenna sidelobe beam. In conclusion it can be said that the decision circuit of our invention as described above offers a very good compromise to achieving reliable air target fuzing in all of the interference environments assumed.

We wish it to be understood that we do not desire to be limited to the exact details of construction shown and described, for obvious modifications will occur to a person skilled in the art.

We claim as our invention:

1. A decision circuit for a proximity fuze, comprising:

(a) a first antenna connected to a first receiver channel, said first antenna having a pattern having a main beam and a plurality of sidelobes;

(b) a second antenna connected to a second receiver channel, said second antenna having a pattern having a broad beam and a gain of less than said main beam but greater than the gain of said sidelobes of said first antenna;

(c) a first means in said first receiver channel to detect and amplify a valid target return signal;

(d) a second means in said first receiver channel to detect and amplify signals having a frequency different from that of a valid target return signal, said second means having a higher gain than said first means;

(e) a first comparison means for producing a signal when the output of said first means exceeds the output of said second means;

(f) a third means in said second receiver channel to detect and amplify signals having a frequency different from the frequency of a valid target return signal; and (g) a second comparison means for producing a signal when enough output from said second means at a lower gain point exceeds the output from said third means by a predetermined difference.

2. The decision circuit of claim 1 in which the output of said first and said second means produce DC signals proportional to the input signals to said first and said second means, respectively, and of opposite polarities, and the output from the lower gain point of said second means and the output from said third means are DC signals of opposite polarities.

3. The decision circuit of claim 2 in which said first and second comparison means comprise a summer for algebraically adding the inputs connected thereto and a threshold detector connected to the output of each of said summers.

4. The decision circuit of claim 1 in which an OR gate is connected to the output of said first comparison means and to the output of said second comparison means.

5. The decision circuit of claim 1 in which the target return signal is a doppler signal, and in which said second means and said third means are adjusted to detect and amplify signals having a frequency higher than said doppler signal.

* * * * *